US008643297B2

(12) United States Patent
Yang et al.

(10) Patent No.: US 8,643,297 B2
(45) Date of Patent: Feb. 4, 2014

(54) CONTROL CIRCUIT AND CONTROL METHOD FOR DIMMING LED LIGHTING CIRCUIT

(75) Inventors: Ta-Yung Yang, Taoyuan County (TW); Li Lin, Taipei (TW); Chi-Yin Lo, Kaohsiung (TW); Kuo-Hsien Huang, New Taipei (TW); Hung-Chun Chen, Hsinchu (TW)

(73) Assignee: System General Corporation, Taipei Hsien (TW)

( * ) Notice: Subject to any disclaimer, the term of this patent is extended or adjusted under 35 U.S.C. 154(b) by 337 days.

(21) Appl. No.: 13/223,660

(22) Filed: Sep. 1, 2011

(65) Prior Publication Data

US 2012/0242252 A1 Sep. 27, 2012

Related U.S. Application Data

(60) Provisional application No. 61/466,161, filed on Mar. 22, 2011.

(51) Int. Cl.
*H05B 37/02* (2006.01)

(52) U.S. Cl.
USPC ..... 315/219; 315/224; 315/307

(58) Field of Classification Search
USPC ..... 315/291, 307, 308, 224, 294, 297, 315/DIG. 4, 276, 283, 219
See application file for complete search history.

(56) References Cited

U.S. PATENT DOCUMENTS

| | | | | |
|---|---|---|---|---|
| 7,592,790 | B2 | 9/2009 | Yang | |
| 7,656,685 | B2 | 2/2010 | Yang et al. | |
| 7,671,578 | B2 | 3/2010 | Li et al. | |
| 8,344,656 | B2 * | 1/2013 | Du et al. | 315/297 |
| 2011/0121754 | A1 * | 5/2011 | Shteynberg et al. | 315/294 |

* cited by examiner

*Primary Examiner* — David H Vu
(74) *Attorney, Agent, or Firm* — Bacon & Thomas, PLLC

(57) ABSTRACT

The present invention provides a control circuit for dimming LED lighting. The control circuit comprises a voltage divider, a controller and an adaptive bleeder. The voltage divider receives an input voltage from an input terminal to generate a dimming signal. The controller generates a switching signal in response to the dimming signal. The controller further generates a control signal in response to the input voltage. The adaptive bleeder receives the control signal and draws a bleeder current from the input terminal in response to the control signal.

19 Claims, 5 Drawing Sheets

CONTROL CIRCUIT AND CONTROL METHOD FOR DIMMING LED LIGHTING CIRCUIT

CROSS REFERENCE TO RELATED APPLICATIONS

This application claims the benefit of U.S. Provisional Application No. 61/466,161, filed on Mar. 22, 2011, the contents of which are incorporated herein by reference.

BACKGROUND OF THE INVENTION

1. Field of the Invention

The present invention relates to LED (light emitting diode) lighting circuit, and more specifically to a control circuit and a control method for dimming LED lighting circuit.

2. Description of the Related Art

FIG. 1 shows a dimmable lighting circuit 100 in conventional arts. The dimmable lighting circuit 100 basically comprises a bilateral triode thyristor TRIAC 110, a bridge rectifier 120 and a load 130. The TRIAC 110 receives an alternating current (AC) mains $V_{AC}$. By controlling a gate voltage of the TRIAC 110, a power sourced from the AC mains $V_{AC}$ can be delivered to the load 130, such as an electric bulb, through the bridge rectifier 120 to achieve dimmable lighting control.

However, in order to make the state of TRIAC 110 being kept at the turning-on state, a minimum holding current is required. That is, a current $I_{AC}$ flowing through the TRIAC 110 should be kept higher than the minimum holding current of the TRIAC 110. However, the level of the load current $I_{LD}$ supplied to the load 130 is equal to that of the current $I_{AC}$. Therefore, the load current $L_{LD}$ needs to meet the requirement of the minimum holding current of the TRIAC 110. Otherwise, if the load 130 is an electric bulb, the TRIAC 110 will be at unstable state between on and off resulting in flickering to the lighting.

BRIEF SUMMARY OF THE INVENTION

The invention is directed to a control circuit and a control method for dimming LED lighting circuit. A first transistor associates with a bleeding resistor to draw a bleeder current from an input terminal in response to a control signal, so that the state of TRIAC is kept at the turning-on state.

According to an aspect of the present invention, a circuit for dimming LED lighting circuit is provided. The circuit comprises a voltage divider, a controller and an adaptive bleeder. The voltage divider receives an input voltage from an input terminal to generate a dimming signal. The controller generates a switching signal in response to the dimming signal. The controller further generates a control signal in response to the input voltage. The adaptive bleeder receives the control signal and draws a bleeder current from the input terminal in response to the control signal.

According to another aspect of the present invention, a control method for dimming LED lighting circuit is provided. The method includes the following steps: generating a dimming signal by a voltage divider in response to an input voltage from an input terminal; generating a switching signal and a control signal by a controller in response to the dimming signal and the input voltage respectively; drawing a bleeder current from the input terminal by an adaptive bleeder in response to the control signal; and clamping a maximum operating voltage for the first transistor by a second transistor.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

The invention can be more fully understood by reading the subsequent detailed description and examples with references made to the accompanying drawings.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
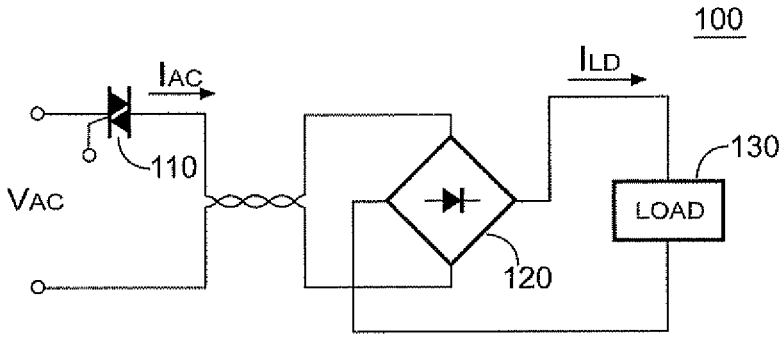
FIG. 1 shows a dimmable lighting circuit in conventional arts.
Figure 2:
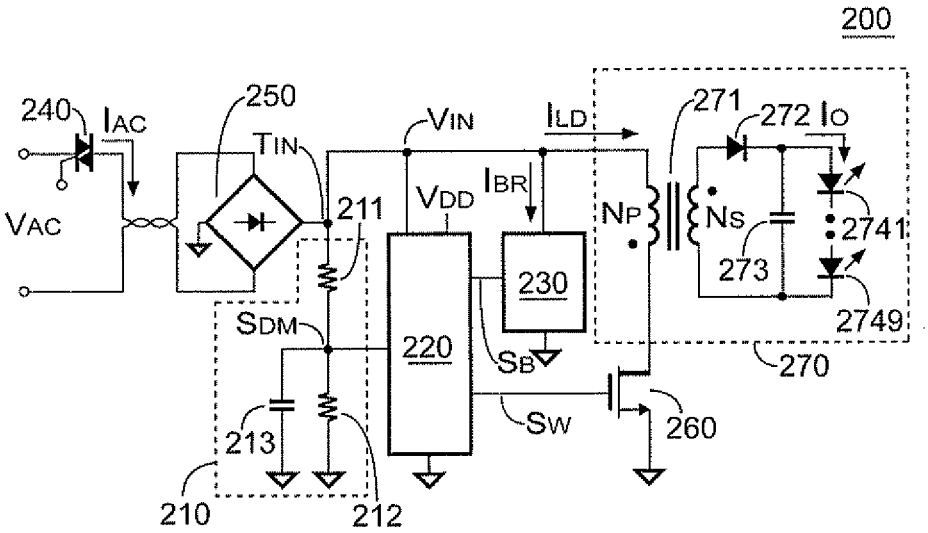
FIG. 2 shows an embodiment of a circuit for a dimming LED lighting circuit according to the present invention.

FIG. 2 shows an embodiment of a control circuit 200 for dimming LED lighting circuit according to the present invention. The control circuit 200 for dimming LED lighting circuit comprises a voltage divider 210, a controller 220 and an adaptive bleeder 230. In one embodiment, the control circuit 200 could further include a TRIAC 240, a bridge rectifier 250, a power transistor 260 and a load 270.

The voltage divider 210, formed by resistors 211 and 212 connected in series, receives an input voltage $V_{IN}$ to generate a dimming signal $S_{DM}$ at a joint of the resistors 211 and 212 in response to the input voltage $V_{IN}$. In one embodiment, the voltage divider 210 could further include a capacitor 213, wherein the capacitor 213 could be utilized to smooth the dimming signal $S_{DM}$ as a direct current level.

The controller 220, having a dimming input terminal for receiving the dimming signal $S_{DM}$, generates a switching signal $S_W$ in response to the dimming signal $S_{DM}$. The controller 220 further generates a control signal $S_B$ which decreases in response to an increment of the input voltage $V_{IN}$.

The bridge rectifier 250 rectifies the AC mains $V_{AC}$ to a direct current (DC) input voltage $V_{IN}$ via the TRIAC 240. The load 270 comprises a magnetic device 271, a rectifier 272, a capacitor 273 and LEDs 2741~2749.

The power transistor 260 is coupled to the controller 220 and the magnetic device 271 to generate a driving current $I_O$ flowing through LEDs 2741~2749 from an input terminal $T_{IN}$ in response to the switching signal $S_W$. The load 270 draws a load current $I_{LD}$ from the input terminal $T_{IN}$. The dimming lighting control of the LEDs 2741~2749 is achieved by means of controlling the level of the driving current $I_O$.

Whenever the adaptive bleeder 230 is not available, the level of the load current $I_{LD}$ would be relatively low as the level of the driving current $I_O$ is low. This would result in an insufficient holding current for the TRIAC 240 and result in flickering to the LED lighting. The lighting flickering problem could be even serious at the valley of the input voltage $V_{IN}$. In order to overcome this problem, the controller 220 generates the control signal $S_B$ for controlling the adaptive bleeder 230 to sink a bleeder current $I_{BR}$ in response to the input voltage $V_{IN}$, when the level of the load current $I_{LD}$ is low. To avoid flickering of the lighting, the sum of the bleeder current $I_{BR}$ and the load current $I_{LD}$, which equals to the current $I_{AC}$, should be higher than a minimum holding current of the TRIAC 240.

Figure 3:
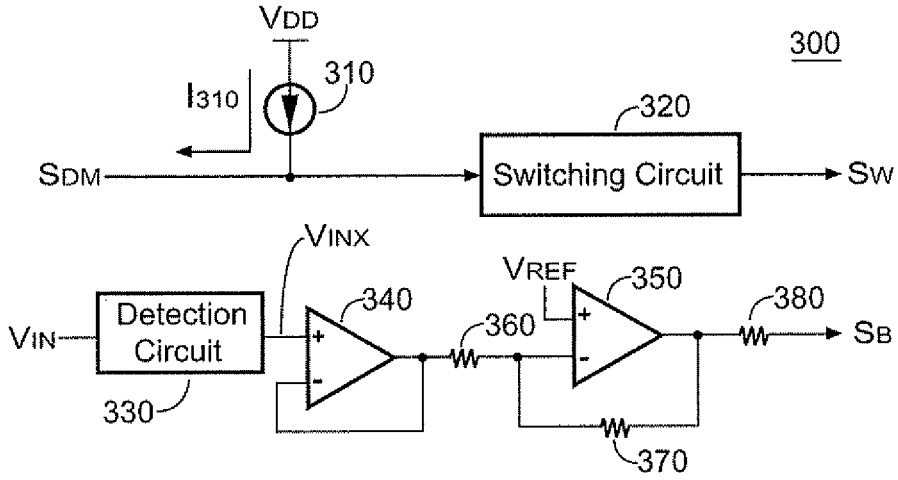
FIG. 3 shows an embodiment of a controller of the circuit for dimming LED lighting circuit according to the present invention.

FIG. 3 shows an embodiment of the controller 220 of control circuit 200 for the dimming LED lighting circuit according to the present invention. The controller 300 comprises a constant current source 310, a switching circuit 320, a detection circuit 330, a buffer 340, an operational amplifier 350, resistors 360, 370 and 380. The constant current source 310 generates a constant current $I_{310}$ toward the dimming input of the controller 300.

The switching circuit 320 receives the dimming signal $S_{DM}$ to generate the switching signal $S_W$ for switching a power transistor 260 shown in FIG. 2. The operation of the switching circuit 320 is well known to those skilled in the arts and will be omitted herein. The detection circuit 330 receives the input voltage $V_{IN}$ to generate a voltage $V_{INX}$. The voltage $V_{INX}$ is proportional to the input voltage $V_{IN}$. A positive input of the buffer 340 receives the voltage $V_{INX}$. The negative input and output of the buffer 340 are coupled to a negative input of the operational amplifier 350 via the resistor 360. A positive input of the operational amplifier 350 is supplied with a reference voltage $V_{REF}$. The resistor 370 is connected between the negative input and an output of the operational amplifier 350 for providing a negative feedback. Therefore the output of the operational amplifier 350 generates the control signal $S_B$ via a resistor 380. The control signal $S_B$ can be expressed as:

$$S_B = \left[V_{REF} \times \left(1 + \frac{R_{370}}{R_{360}}\right)\right] - \left[(V_{INX}) \times \left(\frac{R_{370}}{R_{360}}\right)\right] - V_{380} \quad (1)$$

where $R_{360}$ and $R_{370}$ are respective resistance of resistors 360 and 370; $V_{380}$ is the voltage across the resistor 380. Due to the negative feedback provided by the operational amplifier 350, the control signal $S_B$ will decrease in response to an increment of the voltage $V_{INX}$. The detection and the generation of the voltage $V_{INX}$ can be found in prior arts of "Detection Circuit for Bleeding the Input Voltage of Transformer", U.S. Pat. No. 7,671,578; "Control Method and Circuit with Indirect Input Voltage Detection by Switching Current Slope Detection", U.S. Pat. No. 7,656,685; and "Start-up Circuit with Feedforward Compensation for Power Converters", U.S. Pat. No. 7,592,790; therefore the description of detection and the generation of the voltage $V_{INX}$ would be omitted herein.

The constant current $I_{310}$ and the equivalent resistance of the voltage divider 210 are used for determining the minimum level of the dimming signal $S_{DM}$, wherein the dimming signal $S_{DM}$ is further used for determining a minimum level of the load current $I_{LD}$.

Figure 4:
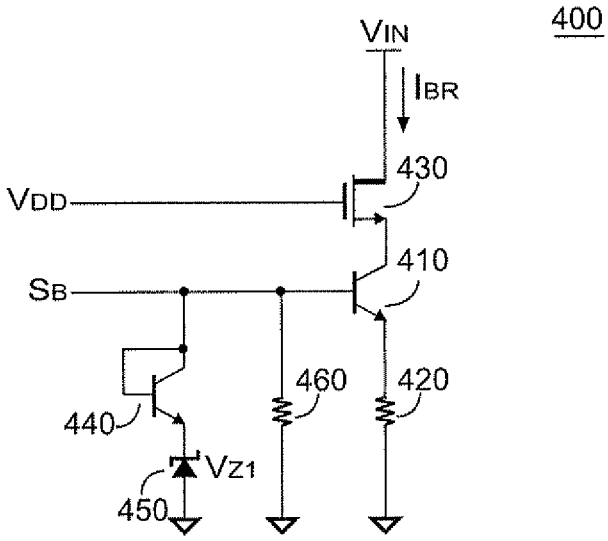
FIG. 4 shows an embodiment of an adaptive bleeder according to the present invention.

FIG. 4 shows an embodiment of the adaptive bleeder 230 according to the present invention. The adaptive bleeder 400 comprises transistors 410, 430, 440, a bleeding resistor 420, a resistor 460 and a zenor diode 450. The adaptive bleeder 400 draws the bleeder current $I_{BR}$ from the input terminal $T_{IN}$ in response to the control signal $S_B$. In an embodiment of the present invention, the transistor 430 is a MOSFET (metal oxide semiconductor field effect transistor), which is a high-voltage device. Transistors 410, 440 are BJTs (bipolar junction transistors), which are low-voltage devices.

A drain of the transistor 430 is coupled to an output of the bridge rectifier 250 shown in FIG. 2, which is the input terminal $T_{IN}$. A gate of the transistor 430 is supplied with a supply voltage $V_{DD}$. In an embodiment of the present invention, the supply voltage $V_{DD}$ is a power supply voltage of the controller 220. The supply voltage $V_{DD}$ is provided by an auxiliary winding (not shown) of the magnetic device 271. A source of the transistor 430 is connected to a collector of the transistor 410. That is, the transistor 430 is cascaded with the transistor 410 to clamp the maximum operating voltage of the transistor 410, such as the voltage at the collector of the transistor 410.

The bleeding resistor 420 is connected between an emitter of the transistor 410 and a ground reference. The base and the collector of the transistor 440 are tied together. The control signal $S_B$ is supplied to the base of the transistor 410 and the collector of the transistor 440. That is, the transistor 410 receives the control signal $S_B$, and the transistor 410 would associate with the bleeding resistor 420 to draw a bleeder current $I_{BR}$ from the input terminal $T_{IN}$ in response to the control signal $S_B$.

A cathode of the zener diode 450 is connected to an emitter of the transistor 440. An anode of the zener diode 450 is connected to the ground reference, wherein the zener diode 450 couples to the transistor 410 to limit a maximum level $I_{BR(MAX)}$ of the bleeder current $I_{BR}$.

The resistor 460 is connected between a base of the transistor 410 and the ground reference. The resistor 460 is utilized to turn off the transistor 410 when the control signal $S_B$ is at floating level. The transistor 440 and the zener diode 450 are connected in series between the base of the transistor 410 and the ground reference to provide a maximum clamping voltage for the transistor 410. The temperature coefficient characteristic of transistors 410 and 440 are selected to be the same therefore the base-to-emitter voltage $V_{BE}$ of the transistor 410 can be compensated by that of the transistor 440. As a result, the voltage across the bleeding resistor 420 will be only determined by a voltage $V_{Z1}$ of the zener diode 450. Therefore, a maximum operating voltage of the transistor 410 at the collector thereof is clamped under the supply voltage $V_{DD}$ by the transistor 430. The maximum level $I_{BR(MAX)}$ of the bleeder current $I_{BR}$ can be therefore expressed as:

$$I_{BR(MAX)} = \frac{V_{Z1}}{R_{420}} \quad (2)$$

where $V_{Z1}$ is the voltage of the zener diode 450 and $R_{420}$ is the resistance of the bleeding resistor 420.

The bleeder current $I_{BR}$ decreases in response to the increment of the input voltage $V_{IN}$. Since the bleeder current $I_{BR}$ and the on-resistance of the transistor 430 causes power consumption, the bleeder current $I_{BR}$ must be decreased in response to the increment of the input voltage $V_{IN}$ from the input terminal $T_{IN}$ for reducing the power consumption and preventing overheating of the transistor 430.

Figure 5:
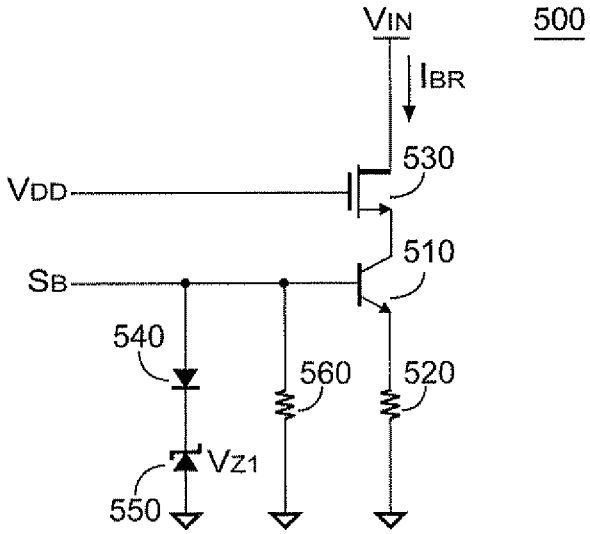
FIG. 5 shows another embodiment of the adaptive bleeder according to the present invention.

FIG. 5 shows another embodiment of the adaptive bleeder 230 according to the present invention. The adaptive bleeder 500 includes transistors 510, 530, a bleeding resistor 520, a resistor 560, a zenor diode 550 and a diode 540, wherein the transistors 510 and 530, the bleeding resistor 520, the resistor 560 and the zenor diode 550 operates the same as transistors 410 and 430, the bleeding resistor 420, the resistor 460 and the zenor diode 450 in FIG. 4, therefore the description of those elements would be omitted herein.

The diode 540, replacing the transistor 440 shown in FIG. 4, is used for cost reduction, wherein the anode of the diode 540 is connected to the base of the transistor 510 and the cathode of the diode 540 is connected to the cathode of the zener diode 550.

Figure 6:
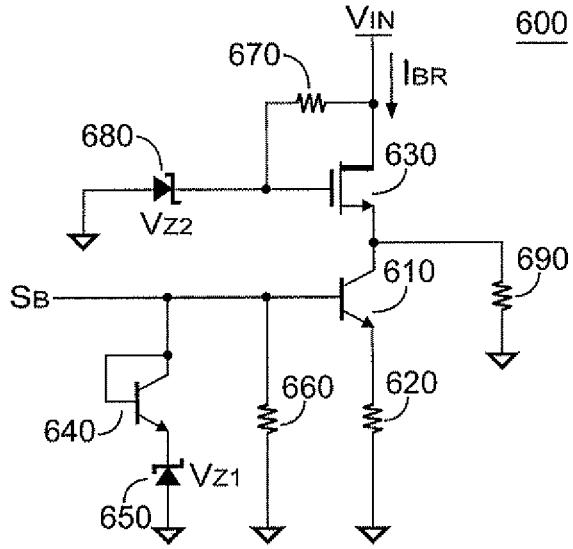
FIG. 6 shows another embodiment of the adaptive bleeder according to the present invention.

FIG. 6 shows another embodiment of the adaptive bleeder 230 according to the present invention. The adaptive bleeder 600 includes transistors 610, 630 and 640, a bleeding resistor 620, resistors 660, 670, an operating resistor 690, a first zenor diode 650 and a second zenor diode 680, wherein the transistors 610, 630 and 640, the bleeding resistor 620, the resistor 660 and the first zenor diode 650 operates the same as transistors 410, 430, 440, the bleeding resistor 420, the resistor 460 and the zenor diode 450 in FIG. 4, therefore the description of those elements would be omitted herein.

The adaptive bleeder 600 draws the bleeder current $I_{BR}$ without using the supply voltage $V_{DD}$. The resistor 670 is connected between the gate and the drain of the transistor 630. The second zenor diode 680 is connected between the gate of the transistor 630 and a ground reference. The resistor 670 and the second zener diode 680 are used to clamp the maximum operating voltage of the transistor 610.

Besides, the operating resistor 690 is connected from a joint of the transistor 630 and 610 to the ground reference to determine a minimum level $I_{BR(MIN)}$ of the bleeder current $I_{BR}$ when the transistor 610 is fully turned off by the control signal $S_B$. This minimum level $I_{BR(MIN)}$ of the bleeder current $I_{BR}$ is determined by the voltage $V_{Z2}$ of the second zener diode 680 and the resistance of the operating resistor 690, which can be expressed as:

$$I_{BR(MIN)} = \frac{V_{Z2} - V_{TH}}{R_{690}} \tag{3}$$

where $V_{Z2}$ is the breakdown voltage of the second zener diode 680; $V_{TH}$ is a threshold voltage of the transistor 630; and $R_{690}$ is the resistance of the operating resistor 690.

Figure 7:
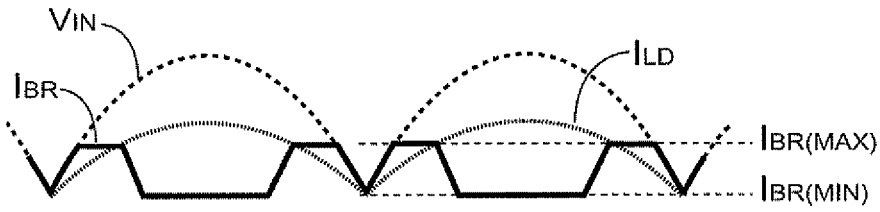
FIG. 7 shows the waveforms of an input voltage, a bleeder current and a load current according to the embodiments of the adaptive bleeder shown in FIG. 4 and FIG. 5.

FIG. 7 shows the waveforms of the input voltage $V_{IN}$, the bleeder current $I_{BR}$ and the load current $I_{LD}$ according to the embodiments of the adaptive bleeders 400 and 500 respectively shown in FIG. 4 and FIG. 5. Since the adaptive bleeders 400 and 500 do not includes the operating resistor 690 shown in FIG. 6, the minimum level $I_{BR(MIN)}$ of the bleeder current $I_{BR}$ is zero.

Figure 8:
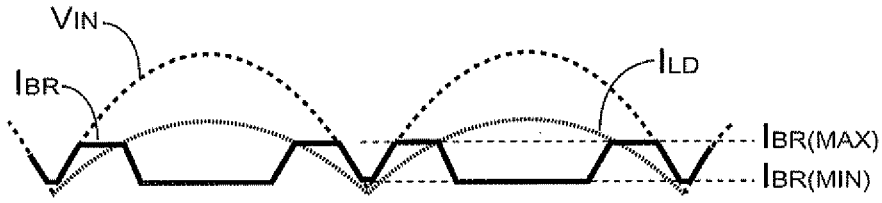
FIG. 8 shows the waveforms of the input voltage, the bleeder current and the load current according to the embodiment of the adaptive bleeder shown in FIG. 6.

FIG. 8 shows the waveforms of the input voltage $V_{IN}$, the bleeder current $I_{BR}$ and the load current $I_{LD}$ according to the embodiment of the adaptive bleeder 600 shown in FIG. 6. Since the operating resistor 690 is used to determine the minimum level $I_{BR(MIN)}$ of the bleeder current $I_{BR}$ when the transistor 610 is fully turned off by the control signal $S_B$, the minimum level $I_{BR(MIN)}$ of the bleeder current $I_{BR}$ is higher than zero.

Figure 9:
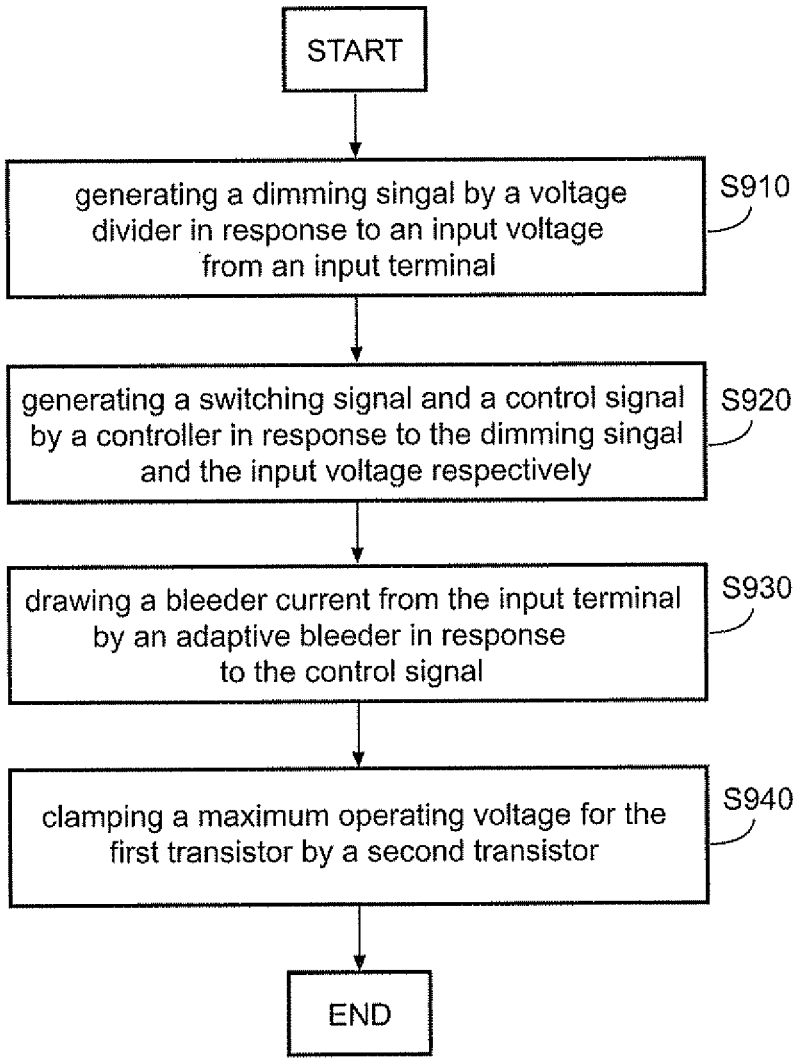
FIG. 9 shows a procedure of control method for dimming LED lighting circuit.

FIG. 9 shows a procedure of a control method for dimming LED lighting circuit. Please refer to FIGS. 2-6. In step S910, a dimming signal ($S_{DM}$) is generated by a voltage divider (210) in response to the input voltage ($V_{IN}$) from the input terminal ($T_{IN}$).

In step S920, a switching signal ($S_W$) and a control signal ($S_B$) are generated by a controller (220) in response to the dimming signal ($S_{DM}$) and the input voltage ($V_{IN}$) respectively. In one embodiment, the control signal ($S_B$) would decrease in response to an increment of the input voltage ($V_{IN}$). The minimum level of the dimming signal ($S_{DM}$) could be determined by a constant current source (310) coupled to the voltage divider (210).

In step S930, a bleeder current ($I_{BR}$) is drawn from the input terminal ($T_{IN}$) by an adaptive bleeder (230) in response to the control signal; wherein the maximum level ($I_{BR(MAX)}$) of the bleeder current ($I_{BR}$) would be limited by a first zener diode (450) coupled to the first transistor (410). The minimum level ($I_{BR(MIN)}$) of the bleeder current ($I_{BR}$) could be determined by an operating resistor (690) coupled to the first transistor (610) and the second transistor (630).

In step S940, a maximum operating voltage is clamped for the first transistor (410) by a second transistor (430). The maximum operating voltage for the first transistor (410) could be limited by a second zener diode (680) coupled to the second transistor (630).

In present invention, a control circuit and a control method for dimming LED lighting circuit are provided. According to the present invention, the sum of the bleeder current $I_{BR}$ and the load current $T_{LD}$ is higher than the minimum holding current of the TRIAC 240 such that the flickering of the lighting is avoided. An objective of the present invention is to provide a control circuit having an adaptive bleeder for dimming LED lighting circuit without flickering to lighting. Another objective of the present invention is to provide a high efficiency LED lighting circuit with lower power consumption.

While the disclosure has been described by way of example and in terms of the exemplary embodiment(s), it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A control circuit for dimming LED lighting circuit, comprising:

a voltage divider, receiving an input voltage from an input terminal to generate a dimming signal;

a controller, generating a switching signal in response to said dimming signal, wherein said controller further generates a control signal in response to said input voltage; and an adaptive bleeder, receiving said control signal and drawing a bleeder current from said input terminal in response to said control signal.

2. The control circuit as claimed in claim 1, wherein said control signal decreases in response to an increment of said input voltage.

3. The control circuit as claimed in claim 1, wherein said adaptive bleeder comprises:

a first transistor, receiving said control signal;

a bleeding resistor, coupled to said first transistor, wherein said first transistor associates with said bleeding resistor to draw said bleeder current from said input terminal in response to said control signal; and a second transistor, being cascaded with said first transistor for clamping a maximum operating voltage for said first transistor.

4. The control circuit as claimed in claim 1, wherein said controller comprises a constant current source coupled to said voltage divider for determining a minimum level of said dimming signal.

5. The control circuit as claimed in claim 3, further comprising a first zener diode coupled to said first transistor to limit a maximum level of said bleeder current, wherein said first transistor is a low-voltage device.

6. The control circuit as claimed in claim 5, further comprising a second zener diode coupled to said second transistor to limit a maximum operating voltage for said first transistor, wherein said second transistor is a high-voltage device.

7. The control circuit as claimed in claim 3, further comprising an operating resistor coupled to said first transistor and said second transistor to determine a minimum level of said bleeder current.

8. The control circuit as claimed in claim 4, wherein said adaptive bleeder comprises:

a first transistor, receiving said control signal;

a bleeding resistor, coupled to said first transistor, wherein said first transistor associates with said bleeding resistor to draw said bleeder current from said input terminal in response to said control signal; and a second transistor, cascaded with said first transistor for clamping a maximum operating voltage for said first transistor.

9. The control circuit as claimed in claim 1, further comprising a power transistor coupled to said controller for generating a driving current for LEDs from said input terminal in response to said switching signal.

10. The control circuit as claimed in claim 8, further comprising:

a first zener diode, coupled to said first transistor to limit a maximum level of said bleeder current; and a second zener diode, coupled to said second transistor to limit the maximum operating voltage for said first transistor.

11. The control circuit as claimed in claim 10, further comprising an operating resistor coupled to said first transistor and said second transistor to limit a minimum level of said bleeder current.

12. A control method for dimming LED lighting circuit, comprising:

generating a dimming signal by a voltage divider in response to an input voltage from an input terminal;

generating a switching signal and a control signal by a controller in response to said dimming signal and said input voltage respectively;

drawing a bleeder current from said input terminal by an adaptive bleeder in response to said control signal.

13. The control method as claimed in claim 12, wherein said control signal decreases in response to an increment of said input voltage.

14. The control method as claimed in claim 12, further comprising determining a minimum level of said dimming signal by a constant current source coupled to said voltage divider.

15. The control method as claimed in claim 12, wherein said adaptive bleeder comprises:

a first transistor, receiving said control signal;

a bleeding resistor, coupled to said first transistor, wherein said first transistor associates with said bleeding resistor to draw said bleeder current from said input terminal in response to said control signal; and a second transistor, being cascaded with said first transistor for clamping a maximum operating voltage for said first transistor.

16. The control method as claimed in claim 15, further comprises:

clamping a maximum operating voltage for said first transistor by a second transistor.

17. The control method as claimed in claim 15, further comprising limiting a maximum level of said bleeder current by a first zener diode coupled to said first transistor.

18. The control method as claimed in claim 15, further comprising limiting the maximum operating voltage for said first transistor by a second zener diode coupled to said second transistor.

19. The control method as claimed in claim 15, further comprising limiting a minimum level of said bleeder current by an operating resistor coupled to said first transistor and said second transistor.

* * * * *